US011864669B2

(12) United States Patent
LaMontagne et al.

(10) Patent No.: US 11,864,669 B2
(45) Date of Patent: Jan. 9, 2024

(54) MERCHANDISER INCLUDING TRACK DOOR SYSTEM

(71) Applicant: Hussmann Corporation, Bridgeton, MO (US)

(72) Inventors: Rick M. LaMontagne, Warrenton, MO (US); Ye Tian, St. Louis, MO (US)

(73) Assignee: Hussmann Corporation, Bridgeton, MO (US)

( * ) Notice: Subject to any disclaimer, the term of this patent is extended or adjusted under 35 U.S.C. 154(b) by 0 days.

(21) Appl. No.: 17/535,295

(22) Filed: Nov. 24, 2021

(65) Prior Publication Data

US 2022/0160146 A1 May 26, 2022

Related U.S. Application Data

(60) Provisional application No. 63/118,539, filed on Nov. 25, 2020.

(51) Int. Cl.
*A47F 3/04* (2006.01)

(52) U.S. Cl.
CPC ..... *A47F 3/043* (2013.01)

(58) Field of Classification Search
CPC .... A47F 3/043; F25D 23/021; F25D 2323/02; E05D 2015/1026; E05D 2015/1055; E05D 2015/1071; E05D 15/0604; E05D 15/0608; E05D 15/0613; E05D 15/0621; E05D 15/0626; E05D 15/063; E05D 15/0643; E05D 15/0652; E05D 15/10; E05D 15/1042; E05D 15/1065; E05Y 2900/31

See application file for complete search history.

(56) References Cited

U.S. PATENT DOCUMENTS

| | | | |
|---|---|---|---|
| 2,858,408 | A | 10/1958 | Barroero |
| 3,655,939 | A | 4/1972 | Stromquist |
| 3,724,129 | A | 4/1973 | Stromquist |
| 3,859,502 | A | 1/1975 | Heaney |
| 4,127,765 | A | 11/1978 | Heaney |
| 4,910,088 | A | 3/1990 | Baudin et al. |
| 5,449,885 | A | 9/1995 | Vandecastele |
| 5,852,284 | A | 12/1998 | Teder et al. |
| 6,052,965 | A | 4/2000 | Florentin et al. |

(Continued)

FOREIGN PATENT DOCUMENTS

| | | | |
|---|---|---|---|
| EP | 1447507 A2 * | 8/2004 | ..... E05D 15/1042 |
| EP | 1203128 B1 | 11/2006 | |

(Continued)

*Primary Examiner* — Andrew M Roersma
(74) *Attorney, Agent, or Firm* — Michael Best & Friedrich LLP

(57) ABSTRACT

A refrigerated merchandiser includes a case defining and separating a product display area from an ambient environment, the case having a frame defining one or more openings to the product display area. An upper track is connected to the case and extends at least partially along the frame. A first door and a second door are moveably connected to the upper track. The first door is configured to move between a closed positioned adjacent the frame and a first open position where the first door is positioned over the second door. The second door is configured to move between a closed positioned adjacent the frame and a second open position where the second door is positioned over the first door.

8 Claims, 13 Drawing Sheets

(56) References Cited

U.S. PATENT DOCUMENTS

| | | | | |
|---|---|---|---|---|
| 6,144,017 | A | 11/2000 | Millett et al. | |
| 6,148,563 | A | 11/2000 | Roche et al. | |
| 6,367,223 | B1 | 4/2002 | Richardson et al. | |
| 6,393,768 | B1 | 5/2002 | Roche et al. | |
| 6,401,399 | B1 | 6/2002 | Roche et al. | |
| 6,539,669 | B1 * | 4/2003 | Heidrich | B61D 19/008 49/213 |
| 6,606,832 | B2 | 8/2003 | Richardson et al. | |
| 6,606,833 | B2 | 8/2003 | Richardson et al. | |
| 6,818,309 | B1 | 11/2004 | Talpaert et al. | |
| 7,905,101 | B2 | 3/2011 | Sunderland et al. | |
| 8,221,846 | B2 | 7/2012 | Roche et al. | |
| 8,534,006 | B2 | 9/2013 | Roche et al. | |
| 8,683,745 | B2 | 4/2014 | Artwohl et al. | |
| 8,881,542 | B2 | 11/2014 | Hixson et al. | |
| 9,052,536 | B2 | 6/2015 | Artwohl et al. | |
| 9,155,405 | B2 | 10/2015 | Artwohl et al. | |
| 9,191,996 | B2 | 11/2015 | Miyamoto | |
| 9,266,307 | B2 | 2/2016 | D'Haene | |
| 9,504,338 | B2 | 11/2016 | Artwohl et al. | |
| 9,532,659 | B2 | 1/2017 | Tsui et al. | |
| 10,039,390 | B2 | 8/2018 | Artwohl et al. | |
| 10,580,333 | B2 | 3/2020 | Artwohl et al. | |
| 10,724,282 | B2 * | 7/2020 | Seo | E05D 15/10 |
| 2002/0073645 | A1 | 6/2002 | Richardson et al. | |
| 2002/0078654 | A1 | 6/2002 | Richardson et al. | |
| 2003/0062813 | A1 | 4/2003 | Cording | |
| 2003/0197449 | A1 | 10/2003 | Cording | |
| 2003/0205059 | A1 | 11/2003 | Roche et al. | |
| 2005/0202178 | A1 | 9/2005 | Roche et al. | |
| 2006/0127586 | A1 | 6/2006 | Roche et al. | |
| 2007/0003700 | A1 | 1/2007 | Roche et al. | |
| 2010/0062152 | A1 | 3/2010 | Roche et al. | |
| 2010/0068398 | A1 | 3/2010 | Roche et al. | |
| 2011/0126561 | A1 | 6/2011 | Sunderland et al. | |
| 2014/0265756 | A1 | 9/2014 | Rasch et al. | |
| 2016/0082983 | A1 * | 3/2016 | Yamaguchi | B61D 19/005 49/287 |
| 2016/0353526 | A1 | 12/2016 | Lee et al. | |
| 2018/0112906 | A1 | 4/2018 | Yi et al. | |
| 2019/0011173 | A1 * | 1/2019 | Xia | E05D 15/10 |
| 2020/0193881 | A1 | 6/2020 | Artwohl et al. | |

FOREIGN PATENT DOCUMENTS

| | | | | | |
|---|---|---|---|---|---|
| EP | 1499218 | B1 | | 1/2008 | |
| EP | 1969976 | A2 | | 9/2008 | |
| EP | 2362046 | A1 | * | 8/2011 | E05D 15/1044 |
| EP | 3091159 | A1 | | 11/2016 | |
| EP | 1935292 | B1 | | 3/2017 | |
| EP | 3159636 | A1 | | 4/2017 | |
| EP | 3194853 | B1 | | 7/2017 | |
| EP | 2707661 | B1 | | 5/2020 | |
| JP | H-05133157 | A | * | 5/1993 | E05D 15/10 |
| JP | H-10169298 | A | * | 6/1998 | E05D 15/06 |
| JP | 2007032177 | A | * | 2/2007 | E05D 15/1042 |
| JP | 4200468 | B1 | * | 12/2008 | E05D 15/1042 |
| KR | 1020110080277 | A | * | 7/2011 | F25D 23/02 |
| WO | WO9830409 | A1 | | 7/1998 | |
| WO | WO0193727 | A2 | | 12/2001 | |
| WO | WO-03002838 | A1 | * | 1/2003 | E05D 15/1065 |
| WO | WO-2012007417 | A1 | * | 1/2012 | B61D 19/005 |
| WO | WO2013110499 | A1 | | 8/2013 | |
| WO | WO-2016063195 | A1 | * | 4/2016 | E05D 15/1042 |
| WO | WO-2018151292 | A1 | * | 8/2018 | E05D 15/10 |

* cited by examiner

MERCHANDISER INCLUDING TRACK DOOR SYSTEM

BACKGROUND

The present invention relates to refrigerated merchandisers, and more specifically to door assemblies for refrigerated merchandisers.

Existing refrigerated merchandisers generally include a case defining a product display area that supports and/or displays products visible and accessible through an opening in the front of the case. Some refrigerated merchandisers, such as low-temperature merchandisers that are used to keep product frozen, include doors that enclose the product display area. The doors typically include one or more glass panels that allow a consumer to view the products stored inside the case. The doors are supported by a frame that includes a header, a footer, and a pair of side rails. If the merchandiser includes more than one door, mullions can be positioned between the doors, extending from the header to the footer. The doors on existing merchandisers are pivotally connected to the frame, opening outward toward the consumer. These doors swing outside the envelope of the case and occupy additional floor space in the aisle, requiring relatively wide aisles to accommodate merchandisers on opposite sides of the aisle.

SUMMARY

The invention provides a track door assembly for merchandisers that have cases to keep product at a low temperature (e.g., −10° Fahrenheit) and to minimize the footprint taken up by the door when moved between an open position and a closed position. Unlike pivotal or swinging doors, the track door generally stays within the envelope of the case. With a track door design, the aisles can be made narrower without sacrificing accessibility. In addition, the overall footprint of the facility can be reduced, or the additional floor space achieved using the track door can be used to merchandise additional product.

The difficulty of implementing a laterally and outwardly translating door on a refrigerated merchandiser is achieving an air-tight seal between the door and the case. The track door of the present invention solves this problem by incorporating a door that has a path and approach angle relative to the case that combines lateral movement and outward or inward movement of the door. In this manner, the track door can be closed and opened in a direction that is substantially normal or perpendicular to the case or door frame. This angle of approach also facilitates use of a seal (e.g., a magnetic seal) between the door and the frame.

In one aspect, the invention provides a rolling-translating door for a refrigerated merchandiser. For example, the door is configured for movement about more than one axis to move (e.g., glide, slide, roll laterally relative to the case, and to move outward and inward relative to the case on a track system.

In some aspects, a user can engage the door and move the door along the track system, or the motion can be initiated and controlled by a controller that is coupled to a motor that engages the door (e.g., via one or more switches or controls).

In one aspect, the door can include or be connected to an automatic storage and retrieval system (ASRS) by integrating controls between the merchandiser and the ASRS. In one example, the track system of the door has an electromechanical switch mechanism that can select one of at least two paths for the door depending on the state of each door in a two-door pair (e.g., one or both doors opened).

In one aspect, the track system includes a four-bar linkage system with a mechanical trip device to select the track or path to be followed. In another aspect, the track system can be controlled with a solenoid actuator to move the switch between alternate paths or tracks.

Before any constructions of the invention are explained in detail, it is to be understood that the invention is not limited in its application to the details of construction and the arrangement of components set forth in the following description or illustrated in the following drawings. The invention is capable of other constructions and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

DETAILED DESCRIPTION

Figure 1:
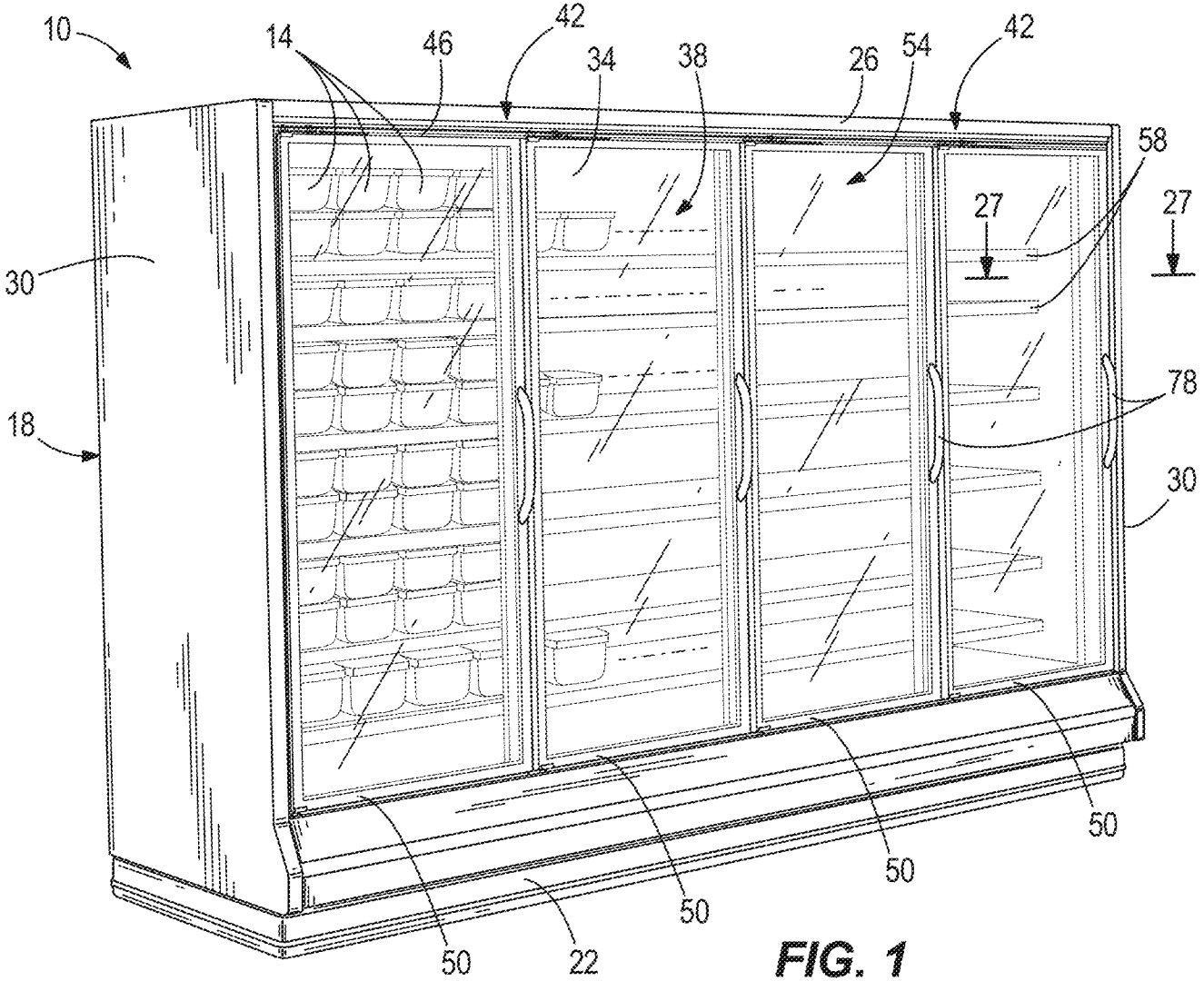
FIG. 1 is a front perspective view of an exemplary refrigerated merchandiser including a case frame and door track assemblies.

FIG. 1 illustrates an exemplary refrigerated merchandiser 10 that may be located in a supermarket, a convenience store, or other suitable retail location (not shown) for presenting fresh food, frozen food, beverages, or other product 14 to consumers. The merchandiser 10 includes a case 18 that is defined by a base 22, a canopy 26, opposite side walls 30, and a rear wall 34. The case 18 also includes an access opening 38 positioned opposite the rear wall 34. The access opening 38 is defined by a case frame assembly 42 that includes a case frame 46. A plurality of doors 50 are coupled to the case frame 46 to provide access to the product 14 through the access opening 38. The area partially enclosed by the base 22, the canopy 26, and the rear wall 34 defines a product support area 54 (e.g., a product display area or volume 54) for supporting the product 14 in the case 18. For example, the food product can be displayed on racks or shelves 58 extending from the rear wall 34 toward the access opening 38, and is accessible by consumers through the doors 50 adjacent a front of the case 18. As shown in FIG. 1, the product 14 and the shelves 58 are visible behind the doors 50. The illustrated product display area 54 can be defined by one or more product display sections that are accessible by a corresponding door 50.

The refrigerated merchandiser 10 also includes a refrigeration system (not shown) that is in communication with the case 18 to provide refrigerated airflow to the product display area 54. The refrigeration system generally includes an evaporator located within an air passageway internal to the case 18. As is known in the art, the evaporator receives a saturated refrigerant that has passed through an expansion valve. The saturated refrigerant is evaporated as it passes through the evaporator as a result of absorbing heat from the airflow passing over the evaporator. The absorption of heat by the refrigerant allows the temperature of the airflow to decrease as it passes over the evaporator. The heated or gaseous refrigerant then exits the evaporator and is pumped back to one or more compressors (not shown) for reprocessing into the refrigeration system. The cooled airflow exiting the evaporator via heat exchange with the liquid refrigerant is directed through the remainder of the air passageway and is introduced into the product display area 54 where the airflow will remove heat from and maintain the product 14 at desired conditions.

FIGS. 2-7 show that one or more of the doors 50 are part of an exemplary track door system 100. The track door system 100 includes a first door 102 and a second door 104 that is mounted to the case frame 106 by a track system. Each of the doors 102, 104 is configured to move outward relative to a case frame 106 and to slide or glide in front of the opposite door. This compound movement allows the doors 102, 104 to fully open to provide access to a product support area, while also closing to form a tight seal between the refrigerated product support area and the external environment.

Figure 2:
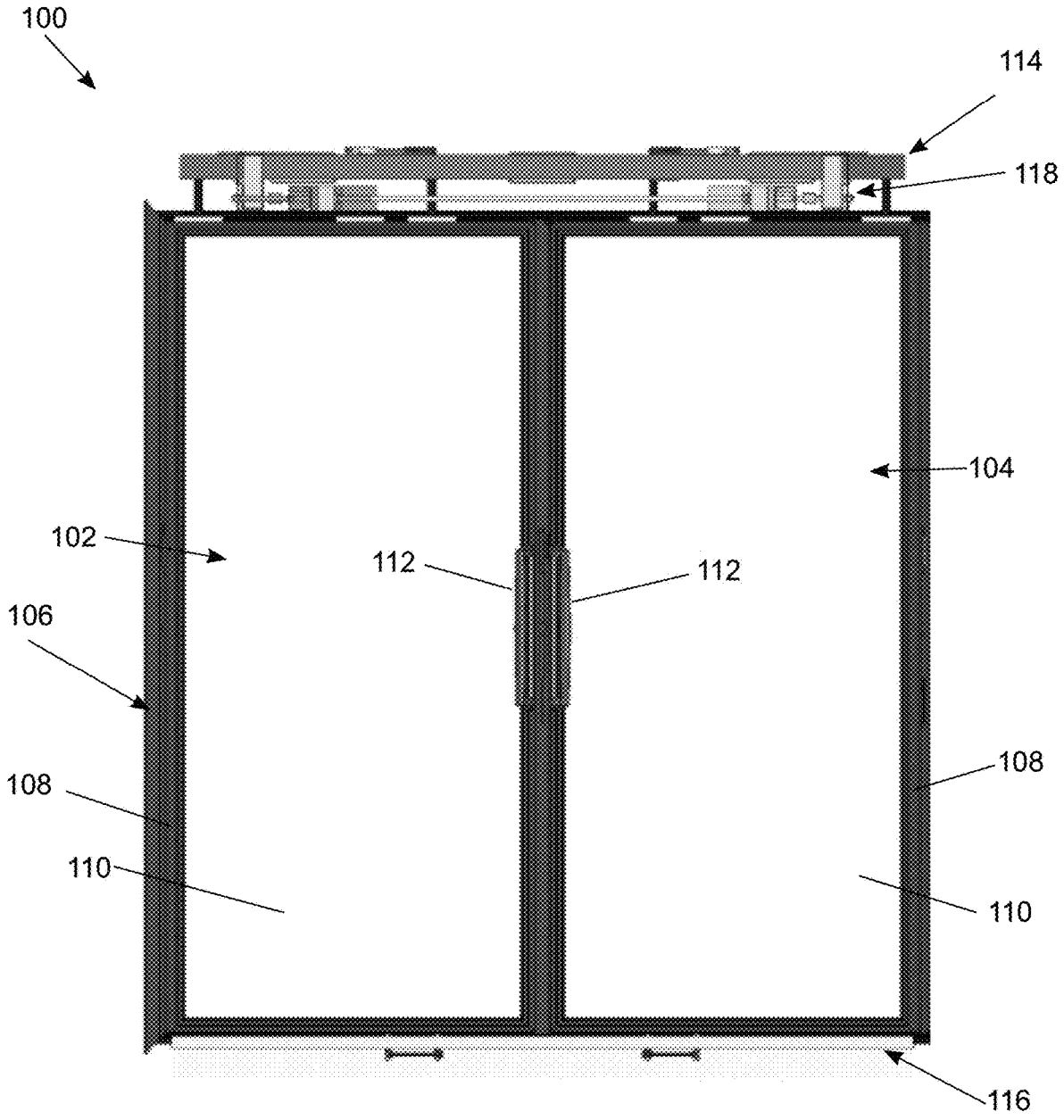
FIG. 2 is a front view of a pair of exemplary doors mounted to the case frame by a track system that has an upper track assembly and a lower track assembly.
Figure 3:
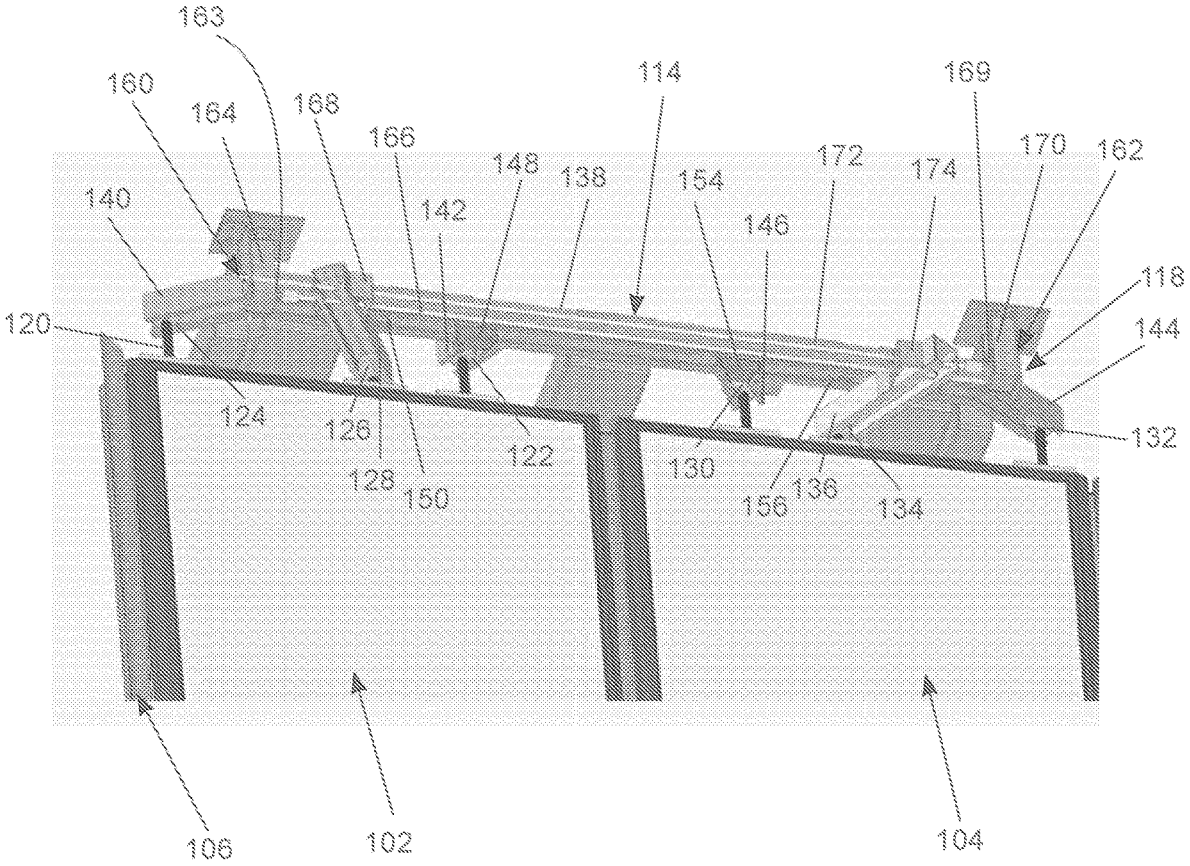
FIG. 3 is a partial, bottom perspective view of the upper track assembly of FIG. 2 with the doors in a closed position.
Figure 4:
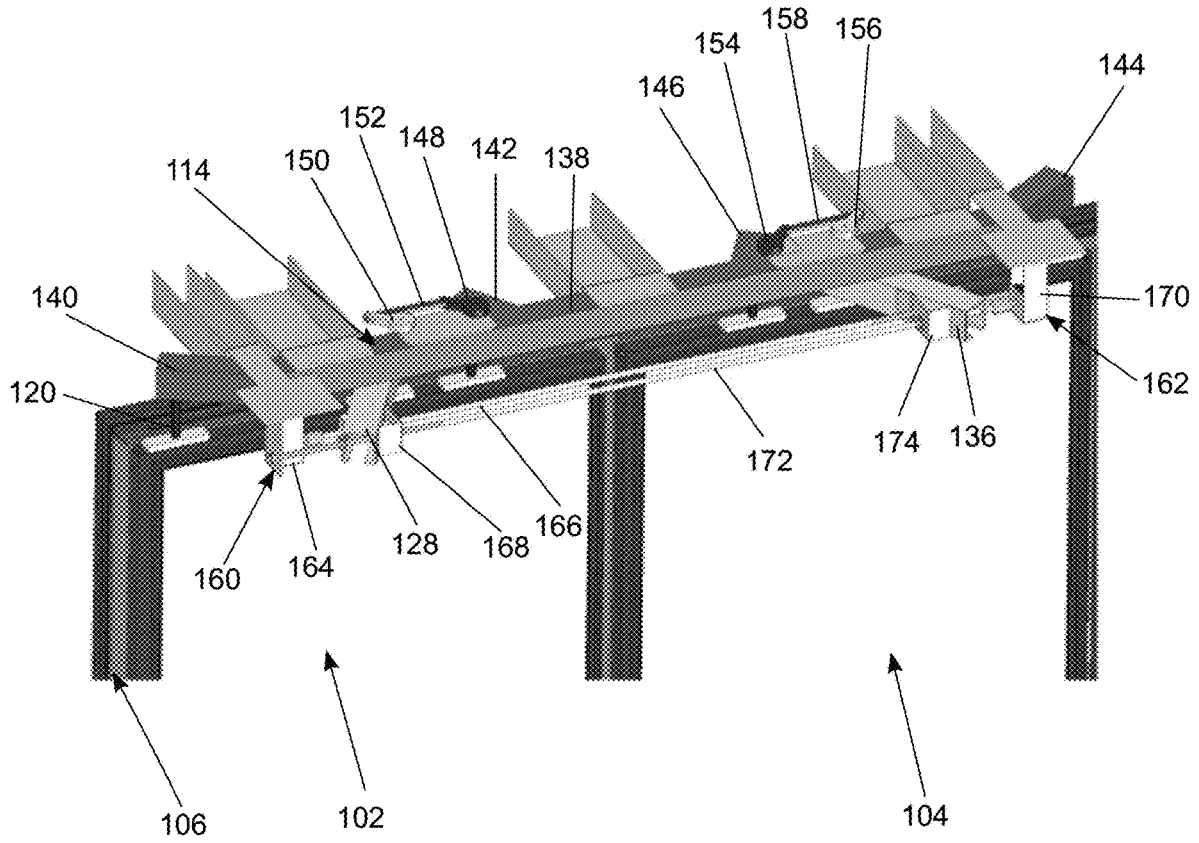
FIG. 4 is a partial, top perspective view of the upper track assembly of FIG. 2 with the doors in the closed position.

As best shown in FIGS. 2-4, each of the doors 102, 104 includes a door frame 108 surrounding one or more glass panels 110. A handle 112 is connected to each of the door frames 108. The doors 102, 104 are positioned in front of respective openings in the case frame 106. The first door 102 and the second door 104 are coupled to the track system that has an upper track assembly 114 and a lower track assembly 116. The doors 102, 104 are moveable along the upper track assembly 114 and lower track assembly 116 between a closed position in which both doors 102, 104 are positioned over their respective openings, a first open position in which the first door 102 slides outwardly from the case frame 106 and laterally in front of the second door 104, and a second open position in which the second door 104 slides outwardly from the case frame 106 and laterally in front of the first door 102. The doors 102, 104 can be moved manually or electronically using an actuator assembly 118.

The doors 102, 104 are connected to the upper track 114 and the actuator assembly 118 by a series of rollers connected to respective shafts 120. The shafts 120 extend from the doors 102, 104 toward the upper track 114. In the illustrated embodiment, the rollers have an axis of rotation that is coaxial to the longitudinal axis of the shaft 120. Other embodiments can utilize other axis of rotation.

Referring to FIG. 3, the first door 102 includes a first leading roller 122, a first trailing roller 124, and a first actuator roller 126. The first leading roller 122 and the first trailing roller 124 are connected to the upper track 114 and the first actuator roller 126 is connected to a first actuator rail 128. The second door 104 includes a second leading roller 130, a second trailing roller 132, and a second actuator roller 134. The second leading roller 130 and the second trailing roller 132 are connected to the upper track 114 and the second actuator roller 134 is connected to a second actuator rail 136. The actuator assembly 118 can be configured to guide the doors 102, 104 between the different positions, either through manual operation, automatic operation, or a combination of both.

As best shown in FIGS. 3 and 4, the upper track 114 has a hollow body defining a substantially C-shaped channel. The upper track 114 incudes a center portion 138 that extends substantially parallel to the case frame 106. A first door end 140 is positioned on one side of the center portion 138. The first door end 140 extends at an oblique angle to the center portion 138 and toward the case frame 106. In the closed position, the first door end 140 receives the first trailing roller 124. A first door spur 142 extends from the center portion 138 at an oblique angle and toward the case frame 106. In the closed position, the first door spur 142 receives the first leading roller 122. A second door end 144 is positioned on the other side of the center portion 138. The second door end 144 extends at an oblique angle to the center portion 138 and toward the case frame 106. In the closed position the second door end 144 receives the second trailing roller 132. A second door spur 146 extends from the center portion 138 at an oblique angle and toward the case frame 106. In the closed position, the second door spur 146 receives the second leading roller 130.

A first gate 148 is positioned at the transition between the first door spur 142 and the center portion 138. The first gate 148 is moveable between a first position where it blocks a path between the first door spur 142 and the center portion 138 and a second position where it opens into the center portion 138 to provide a path between the first door spur 142 and the center portion 138. A first stop 150 is connected to the first gate through a first link 152. The first stop 150 is configured to move with the first gate 148 via the first link 152.

A second gate 154 is positioned at the transition between the second door spur 146 and the center portion 138. The second gate 154 is moveable between a first position where it blocks a path between the second door spur 146 and the center portion 138 and a second position where it opens into the center portion 138 to provide a path between the second door spur 146 and the center portion 138. A second stop 156 is connected to the second gate 154 through a second link 158. The second stop 156 is configured to move with the second gate 154 via the second link 158.

The actuator assembly 118 includes the first actuator rail 128 connected to a first linear actuator 160 and the second actuator rail 136 connected to a second linear actuator 162 so that the actuator rails 128, 136 are independently moveable of one another. The actuator rails 128, 136 each include a hollow body defining a substantially C-shaped channel that receives a respective actuator roller 126, 134. The actuator rails 128, 136 extend at an oblique angle to the center portion of the upper track 114 and away from the case frame 106.

As shown in FIGS. 3 and 4, the first linear actuator 160 includes a first motor 163 positioned in a first motor housing 164 and a rotatable first lead screw 166 connected to the first motor. The first actuator rail 128 is keyed to the first lead screw 166 by a first actuator bracket 168. Rotation of the first motor 163 causes rotation of the first lead screw 166, and translation of the first actuator rail 128 relative to the case frame 106. The second linear actuator 162 includes a second motor 169 that is positioned in a second motor housing 170, and a rotatable second lead screw 172. The second actuator rail 136 is keyed to the second lead screw 172 by a second actuator bracket 174. Rotation of the second motor 169 causes rotation of the second lead screw 172, and translation of the second actuator rail 136 relative to the case frame 106.

Figure 5:
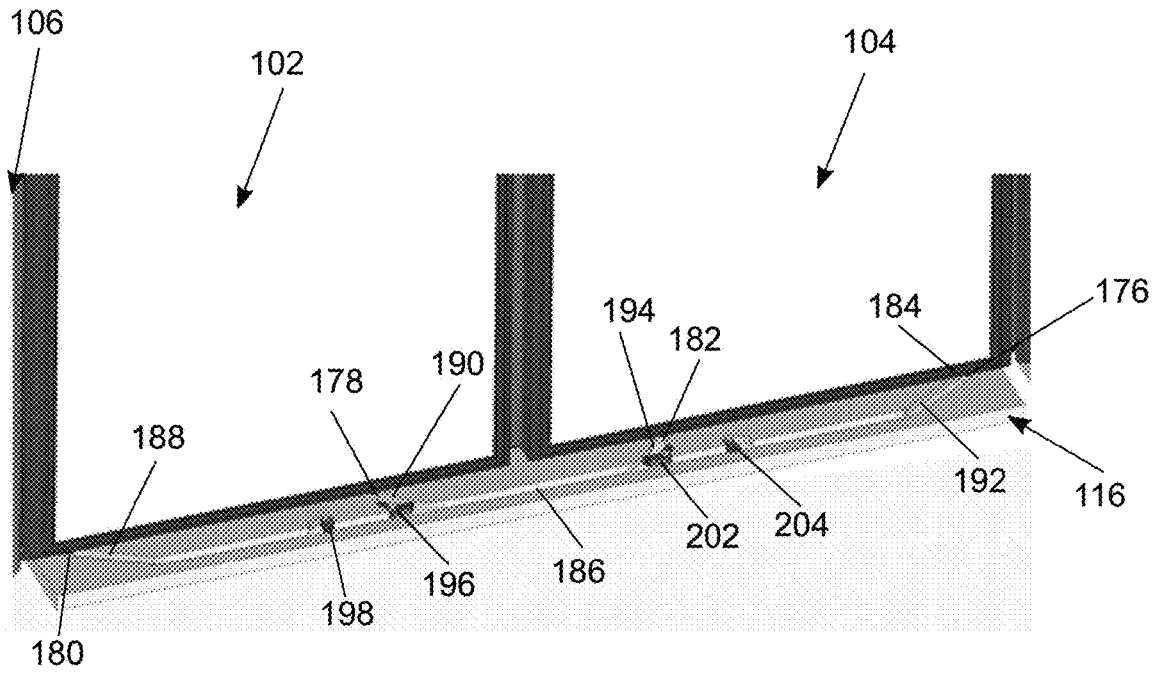
FIG. 5 is a partial, top perspective view of the lower track assembly with the doors in the closed position.
Figure 6:
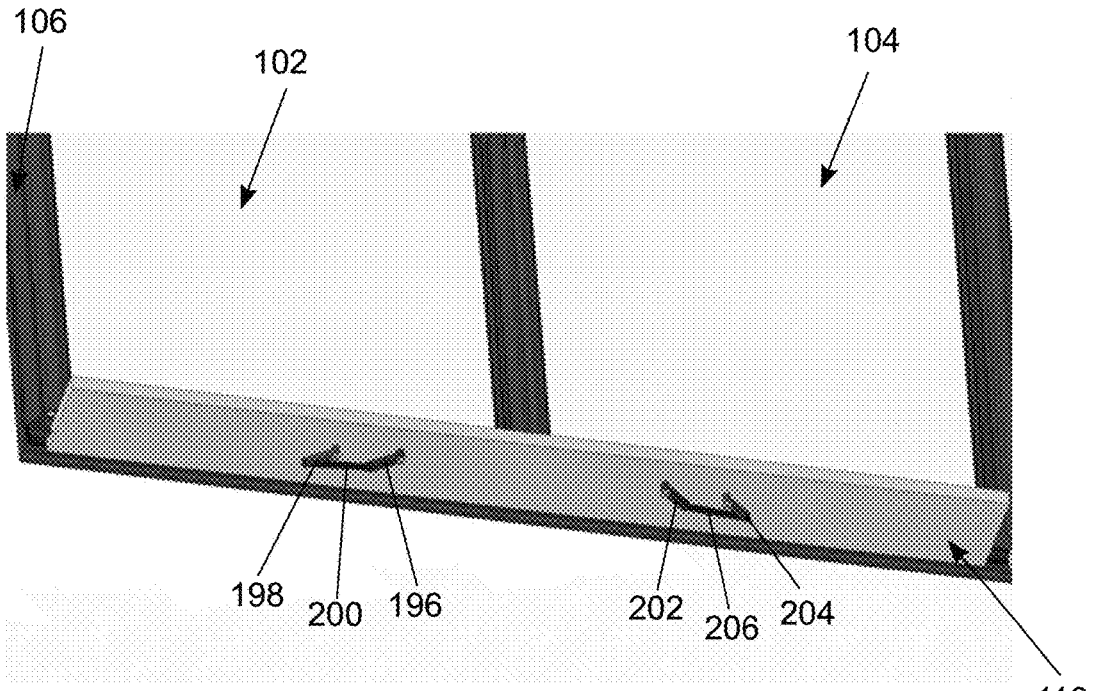
FIG. 6 is a partial, bottom perspective view of the lower track assembly with the doors in the closed position.

As best shown in FIGS. 5 and 6 the doors 102, 104 are connected to the lower track 116 by a series of lower rollers that are connected to respective lower shafts 176. The lower shafts 176 extend from the doors 102, 102 toward the lower track 116. In the illustrated embodiment, the lower rollers have an axis of rotation that is coaxial to the longitudinal axis of the lower shaft 176. Other embodiments can utilize a different axis of rotation.

The first door 102 includes a first leading lower roller 178 and a first trailing lower roller 180. The first leading lower roller 178 and the first trailing lower roller 180 are connected to the lower track 116. The second door 104 includes a second leading lower roller 182 and a second trailing lower roller 184. The second leading lower roller 182 and the second trailing lower roller 184 are connected to the lower track 116.

The lower track 116 has a body defining a slot. The slot incudes a lower center portion 186 that extends substantially parallel to the case frame 106. A first lower door end 188 is positioned on one side of the lower center portion 186. The lower first door end 188 extends at an oblique angle to the lower center portion 186 and toward the case frame 106. In the closed position, the first lower door end 188 receives the first trailing lower roller 180. A first lower door spur 190 extends from the lower center portion 186 at an oblique angle and toward the case frame 106. In the closed position, the first lower door spur 190 receives the first leading lower roller 178. A second lower door end 192 is positioned on the other side of the lower center portion 186. The second lower door end 192 extends at an oblique angle to the lower center portion 186 and toward the case frame 106. In the closed position the second lower door end 192 receives the second trailing lower roller 184. A second lower door spur 194 extends from the lower center portion 186 at an oblique angle and toward the case frame 106. In the closed position, the second lower door spur 194 receives the second leading lower roller 182.

A first lower gate 196 is positioned at the transition between the first lower door spur 190 and the lower center portion 186. The first lower gate 196 is moveable between a first position where it blocks a path between the first lower door spur 190 and the lower center portion 186 and a second position where it opens into the lower center portion 186 to provide a path between the first lower door spur 190 and the lower center portion 186. A first lower stop 198 is connected to the first lower gate 196 through a first lower link 200. The first lower stop 198 is configured to move with the first lower gate 196 via the first lower link 200.

A second lower gate 202 is positioned at the transition between the second lower door spur 194 and the lower center portion 186. The second lower gate 202 is moveable between a first position where it blocks a path between the second lower door spur 194 and the lower center portion 186 and a second position where it opens into the lower center portion 186 to provide a path between the second lower door spur 194 and the lower center portion 186. A second lower stop 204 is connected to the second lower gate 202 through a second lower link 206. The second lower stop 204 is configured to move with the second lower gate 202 via the second lower link 206.

Figure 7:
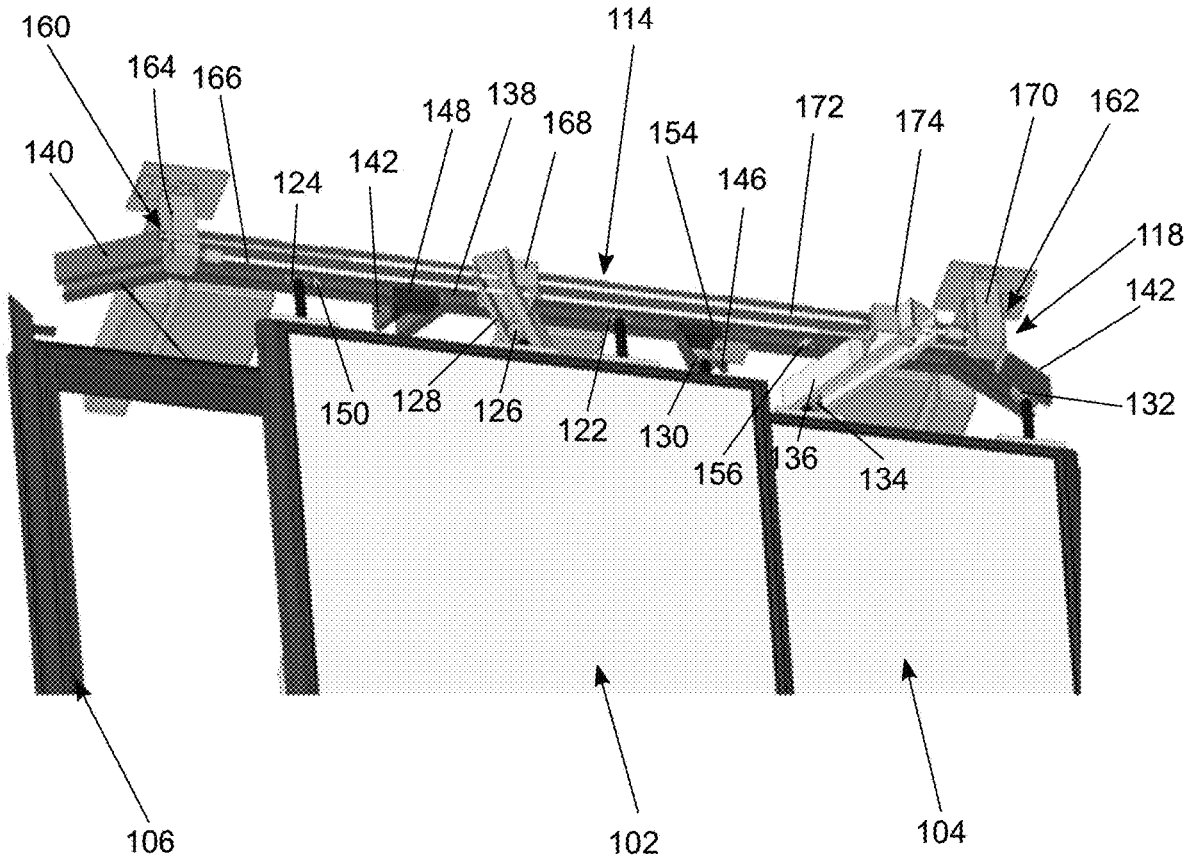
FIG. 7 is a partial, bottom perspective view of the upper track assembly with a first door in an open position.

FIG. 7 shows the track door assembly 100 in a first open position with the first door 102 moving in front of the second door 104. During an opening sequence, the first linear actuator 160 can be activated to translate the first actuator rail 128 relative to the case frame 106. The first gate 148 is opened, allowing the first leading roller 122 to move from the first door spur 142 into the center portion 138 of the upper track 114. The first gate 148 can be opened manually by the first leading roller 122 or automatically through a control mechanism (e.g., rotary actuator, solenoid, etc.). As the first actuator rail 128 moves, the first leading roller 122 follows the path of the first door spur 142 and the first trailing roller 124 follows the path of the first door end 140 in moving horizontally relative to the case frame 106 and outwardly away from the case frame 106. This disengages a seal between the first door 102 and the case frame 106 and moves the first door 102 outwardly in front of the second door 104. To accommodate for this movement, the first actuator roller 126 moves inside the first actuator rail 128 away from the case frame 106. The first lower gate 196 follows similar movements with the first leading lower roller 178 moving through and exiting the first lower door spur 190 into the lower center portion 186 and the first trailing lower roller 180 moving through and exiting the first lower door end 188 into the lower center portion 186.

During closing, the first motor 163 and the rotation of the first lead screw 166 is reversed, causing the first door 102 to move back over the first opening. The first leading roller 122 will engage the first gate 148 which guides the first leading roller 122 into the first door spur 142. As the first leading roller 122 enters the first door spur 142, the first trailing roller 124 enters the first door end 140, which moves the first door 102 toward the case frame 106 and reengages the door seal.

Similar movement is followed when the second door 104 opens, moving into the center portion 138 of the upper track 114 and the lower center portion 186 of the lower track 116 and in front of the first door 102. Accordingly, the first and second doors 102, 104 move at least partially along at the same path to open and close.

In certain aspects, opening and closing the doors can be controlled by an electronic control system and activated by a user input. The control system can include one or more controllers configured to operate the linear actuators and gates. Control logic can be used to ensure that only one door opens at a time. In other aspects, the actuator assembly can be replaced with mechanisms that allow the doors to be operated entirely manually.

In some aspects, the doors 102, 104 can be integrated with an automatic storage and retrieval system (ASRS) where little to no user input is needed to operate the track system 100. In some constructions, the can include a user access device that provides product location information and location notification to a user that directs a user to a specific product area. The doors can be activated to open when a user is near the location so that the user can retrieve the products. Once the product has been retrieved and the user clears the door, the door can be closed. In these embodiments, the user can be a shopper at a store, a store employee, or a robotic system at a store or storage facility.

In some embodiments, the illustrated linear actuator can be replaced with other drive mechanisms, such as a belt drive system, rack and pinon system, or other suitable mechanisms.

Although two doors 102, 104 are shown with the track system 100, other configurations including one door, three doors, four doors, or more can be used as needed. For example, a three door system can be configured so that both of the end doors move over the middle door and the middle door moves over one or more of the end doors.

FIGS. 8-11 show an exemplary embodiment of another track door system 210 that can be used for a refrigerated merchandiser. The track door assembly 210 includes a first door 212 and a second door 214. Each of the doors 212, 214 is configured to move outwardly relative to a case frame 216 and to move in front of the opposite door. This compound movement allows the doors 212, 214 to fully open to provide access to a product support area, while also closing to form a tight seal between the refrigerated product support area and the external environment.

Figure 8:
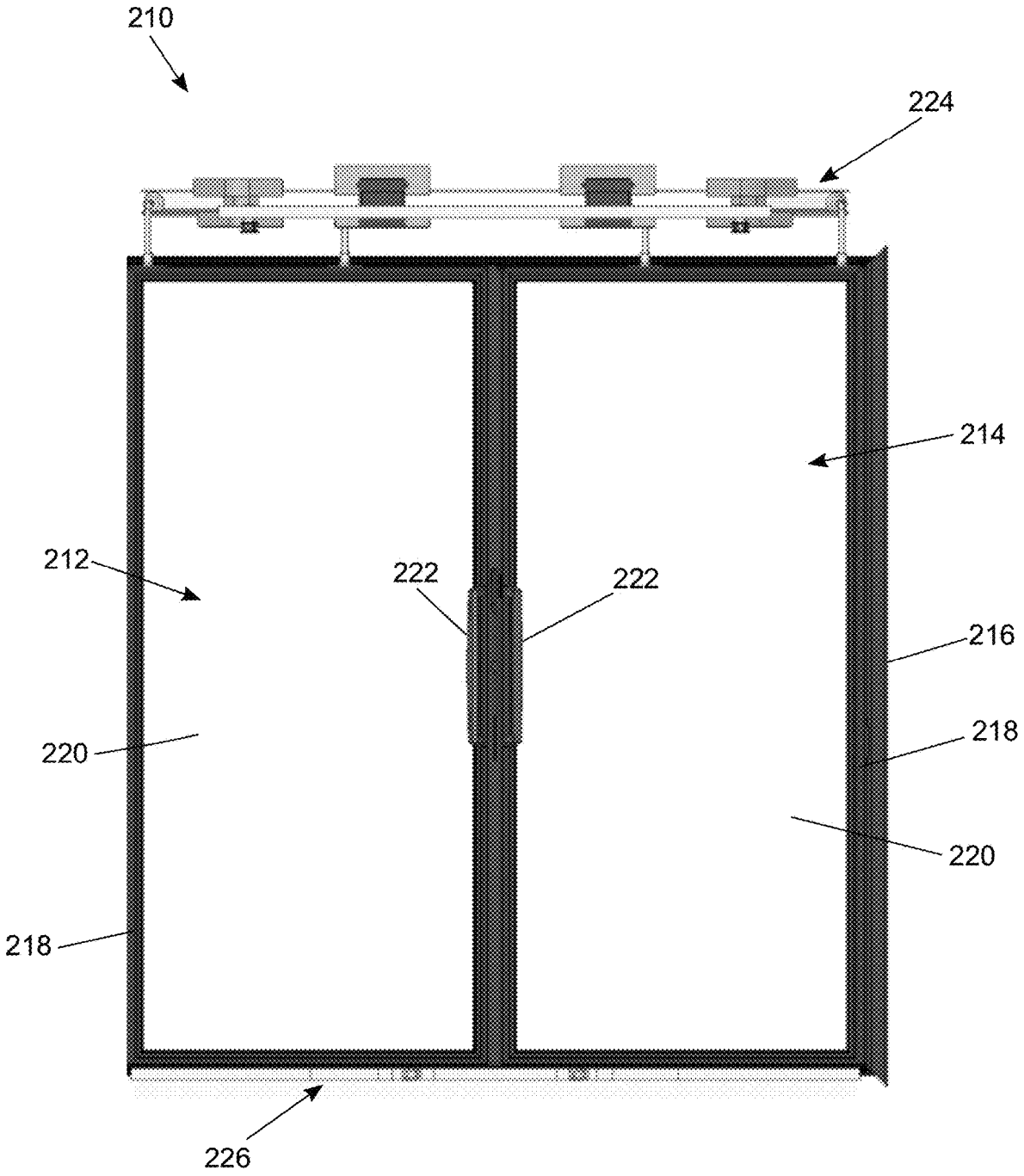
FIG. 8 is a front view of another door assembly including a pair of doors mounted to a case frame by another exemplary track system including an upper track assembly and a lower track assembly.

As best shown in FIG. 8, each of the doors 212, 214 includes a door frame 218 surrounding one or more glass panels 220. A handle 222 is connected to each of the door frames 218. The doors 212, 214 are positioned in front of respective openings in the case frame 216. The first door 212 and the second door 214 are coupled to the track system that has an upper track assembly 224 and a lower track assembly 226. The doors 212, 214 are moveable along the upper track 224 and the lower track 226 between a closed position where both doors 212, 214 are positioned over the respective opening, a first open position where the first door 212 slides outwardly from the case frame 216 and in front of the second door 214, and a second open position in which the second door 214 slides outwardly from the case frame 216 and laterally in front of the first door 212. The doors 212, 214 can be moved manually or electronically using an actuator assembly (not shown).

Figure 9:
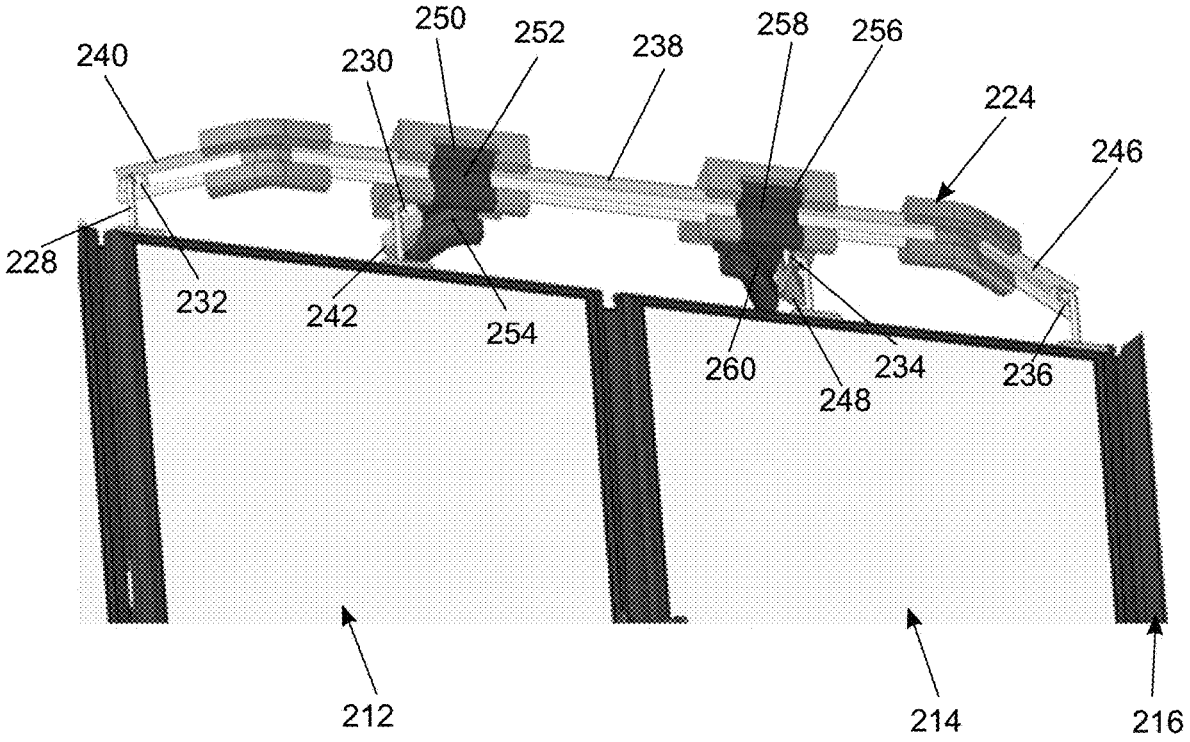
FIG. 9 is a partial, bottom perspective view of the upper track assembly with the doors in a closed position.

As best shown in FIG. 9, the doors 212, 214 are connected to the upper track 224 by a series of rollers connected to respective shafts 228. The shafts 228 extend from the door toward the upper track 224. In the illustrated embodiment, the rollers have an axis of rotation that is perpendicular to the longitudinal axis of the shaft 228. Other embodiments can utilize other axis of rotation.

The first door 212 includes a first leading roller 230 and a first trailing roller 232. The first leading roller 230 and the first trailing roller 232 are connected to the upper track 224. The second door 214 includes a second leading roller 234 and a second trailing roller 236. The second leading roller 234 and the second trailing roller 236 are connected to the upper track 224.

As shown in FIG. 9, the upper track 224 has a hollow body defining a substantially C-shaped channel. The upper track 224 incudes a center portion 238 that extends substantially parallel to the case frame 216. A first door end 240 is positioned on one side of the center portion 238. The first door end 240 extends at an oblique angle to the center portion 238 and toward the case frame 216. In the closed position, the first door end 240 receives the first trailing roller 232. A first door spur 242 is connected to and extends from the center portion 238 at an oblique angle and toward the case frame 216. In the closed position, the first door spur 242 receives the first leading roller 230. A second door end 246 is positioned on the other side of the center portion 238. The second door end 246 extends at an oblique angle to the center portion 238 and toward the case frame 216. In the closed position the second door end 246 receives the second trailing roller 236. A second door spur 248 is connected to and extends from the center portion 238 at an oblique angle and toward the case frame 216. In the closed position, the second door spur 248 receives the second leading roller 234.

A first gate 250 is positioned at the transition between the first door spur 242 and the center portion 238. The first gate 250 includes a first linear channel 252 and a first curved channel 254. The first gate 250 is moveable between a first position where the first linear channel 252 provides an extension across the center portion 238 and a second position where the first gate 250 moves away from the case frame 216 so that the first curved channel 254 provides a path between the first door spur 242 and the center portion 238. The first gate 250 can be moved by a linear actuator, for example a solenoid actuator.

A second gate 256 is positioned at the transition between the second door spur 248 and the center portion 238. The second gate 256 includes a second linear channel 258 and a second curved channel 260. The second gate 256 is moveable between a first position where the second linear channel 258 provides an extension across the center portion 238 and a second position where the second gate 256 moves away from the case frame 216 so that the second curved channel 260 provides a path between the second door spur 248 and the center portion 238. The second gate 256 can be moved by a linear actuator, for example a solenoid actuator.

Figure 10:
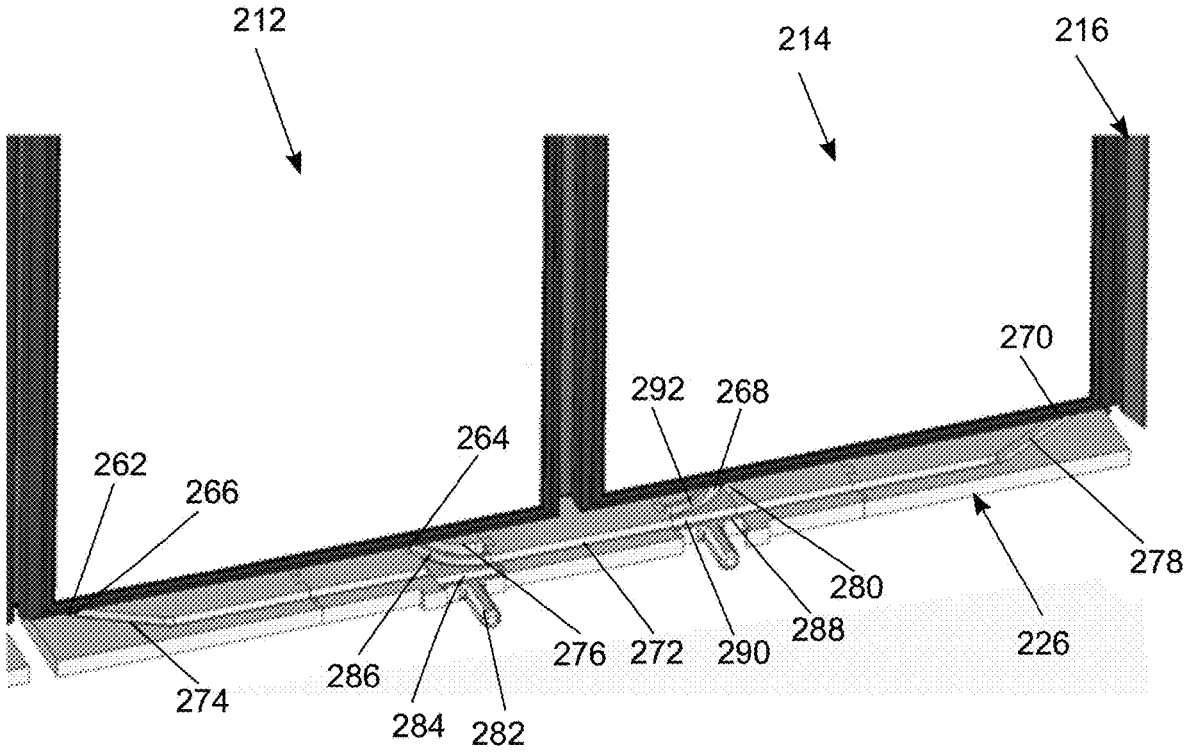
FIG. 10 is a partial, top perspective view of the lower track assembly with the doors in a closed position.

As best shown in FIG. 10, the doors 212, 214 are connected to the lower track by a series of lower rollers connected to respective lower shafts 262. The lower shafts 262 extend from the doors 212, 214 toward the lower track 226. In the illustrated embodiment, the lower rollers have an axis of rotation that is coaxial to the longitudinal axis of the lower shaft 262. Other embodiments can utilize a different axis of rotation.

The first door 212 includes a first leading lower roller 264 and a first trailing lower roller 266. The first leading lower roller 264 and the first trailing lower roller 266 are connected to the lower track 226. The second door 214 includes a second leading lower roller 268 and a second trailing lower roller 270. The second leading lower roller 268 and the second trailing lower roller 270 are connected to the lower track 226.

The lower track 226 has a body defining a slot. The slot incudes a lower center portion 272 that extends substantially parallel to the case frame 216. A first lower door end 274 is positioned on one side of the lower center portion 272. The first lower door end 274 extends at an oblique angle to the lower center portion 272 and toward the case frame 216. In the closed position, the first lower door end 274 receives the first trailing lower roller 266. A first lower door spur 276 extends from the lower center portion 272 at an oblique angle and toward the case frame 216. In the closed position, the first lower door spur 276 receives the first leading lower roller 264. A second lower door end 278 is positioned on the other side of the lower center portion 272. The second lower door end 278 extends at an oblique angle to the lower center portion 272 and toward the case frame 216. In the closed position the second lower door end 278 receives the second trailing lower roller 270. A second lower door spur 280 extends from the lower center portion 272 at an oblique angle and toward the case frame 216. In the closed position, the second lower door spur 280 receives the second leading lower roller 268.

A first lower gate 282 is positioned at the transition between the first lower door spur 276 and the lower center portion 272. The first lower gate 282 includes a first lower linear channel 284 and a first lower curved channel 286. The first lower gate 282 is moveable between a first position where the first lower linear channel 284 provides an extension across the lower center portion 272 and a second position where the first lower gate 282 moves away from the case frame 216 so that the first lower curved channel 286 provides a path between the first lower door spur 276 and the lower center portion 272. The first lower gate 282 can be moved by a linear actuator, for example a solenoid actuator.

A second lower gate 288 is positioned at the transition between the second lower door spur 280 and the lower center portion 272. The second lower gate 288 includes a second lower linear channel 290 and a second lower curved channel 292. The second lower gate 288 is moveable between a first position where the second lower linear channel 290 provides an extension across the lower center portion 272 and a second position where the second lower gate 288 moves away from the case frame 216 so that the second lower curved channel 292 provides a path between the second lower door spur 280 and the lower center portion 272. The second lower gate 288 can be moved by a linear actuator, for example a solenoid actuator.

Figure 11:
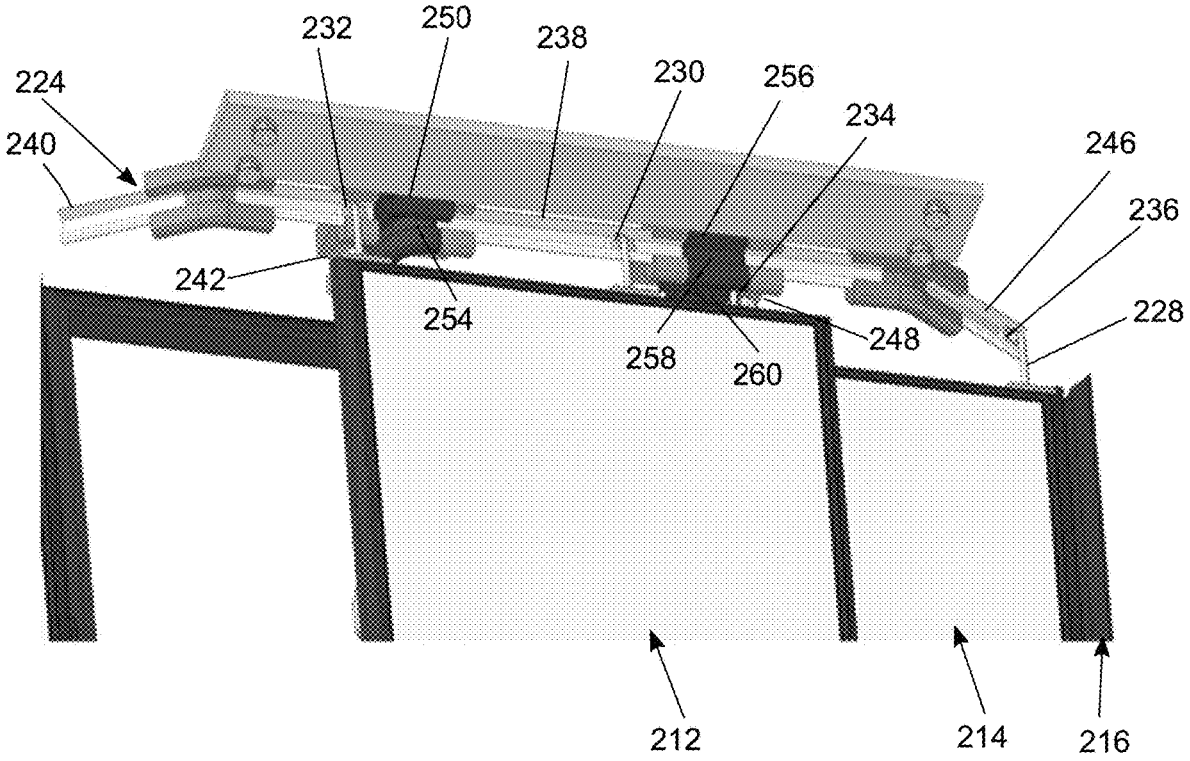
FIG. 11 is a partial, bottom perspective view of the upper track assembly with the first door in an open position.

FIG. 11 shows the track door assembly 210 in a first open position with the first door 212 moving in front of the second door 214. During an opening sequence, the first gate 250 can be activated to move away from the case frame 216 to connect the first curved channel 254 with the center portion 238, allowing the first leading roller 230 to move from the first door spur 242 into the center portion 238 of the upper track 224. The first leading roller 230 follows the path of the first door spur 242 and the first trailing roller 232 follows the path of the first door end 240 in moving horizontally relative to the case frame 216 and outwardly away from the case frame 216. This disengages a seal between the first door 212 and the case frame 216 and moves the first door 212 outwardly in front of the second door 214. The first lower gate 282 and lower rollers follow similar movements with the first leading lower roller 264 moving through and exiting the first lower door spur 276 into the lower center portion 272 and the first trailing lower roller 266 moving through and exiting the first lower door end 274 into the lower center portion 272.

During closing, the first leading roller 230 will engage the first gate 250 to guide the first leading roller 230 into the first door spur 242. As the first leading roller 230 enters the first door spur 242 the first trailing roller 232 enters the first door end 240, which moves the first door 212 toward the case frame 216 and reengaging the door seal.

In certain aspects, opening and closing the doors can be controlled by an electronic control system and activated by a user input. The control system can include one or more controllers configured to operate the linear actuators and gates. Control logic can be used to ensure that only one door opens at a time. In other aspects, the actuator assembly can be replaced with mechanisms that allow the doors to be operated entirely manually.

In some aspects, the doors can be integrated with an automatic storage and retrieval system (ASRS) where little to no user input is needed to operate the track system 210. Certain embodiments can include a user access device that provides product location information and location notification to a user that directs a user to a specific product area. The doors can be activated to open when a user is near the location so that the user can retrieve the products. After the product has been retrieved and the user clears or moves away from the door, the door can be automatically closed. In these embodiments, the user can be a shopper at a store, a store employee, or a robotic system at a store or storage facility.

Although two doors 212, 244 are shown with the track system 210, other configurations including one door, three doors, four doors, or more can be used as needed. For example, a three door system can be configured so that both of the end doors move over the middle door and the middle door moves over one or more of the end doors.

FIGS. 12-16 show schematic examples of different drive systems that can be used in the track door systems 100, 210. The drive systems include a toothed timing belt along with a DC variable speed motor or a DC stepper motor with a toothed drive gear that mates with the teeth on the belt. These drive systems can be coupled to or disposed in the track door systems 100, 210 to move the doors 212, 244 between the open and closed positions.

Figure 12:
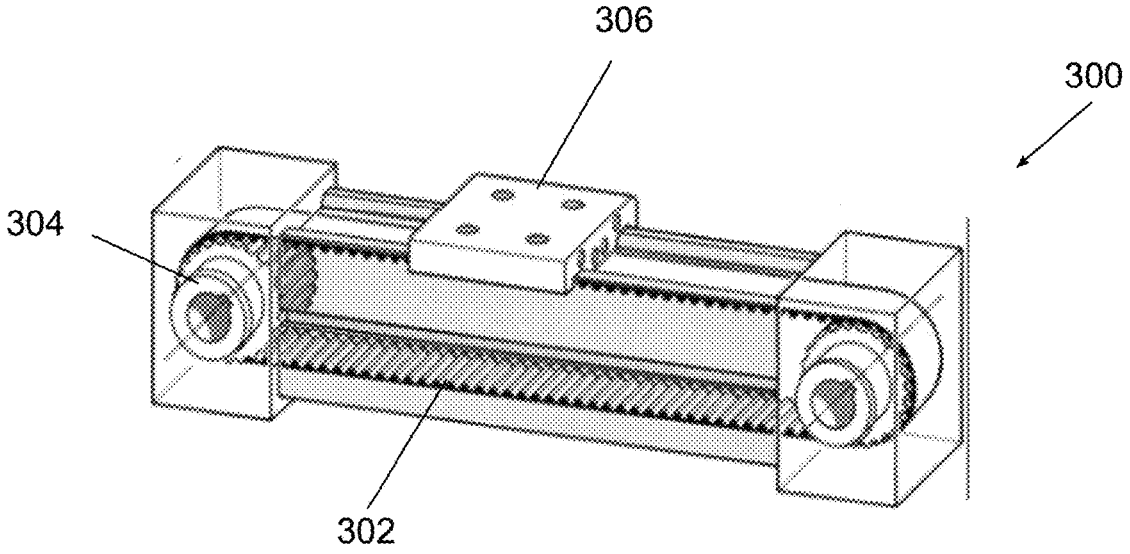
FIG. 12 is a perspective, schematic of an exemplary drive system that can be used with the track door system.
Figure 13:
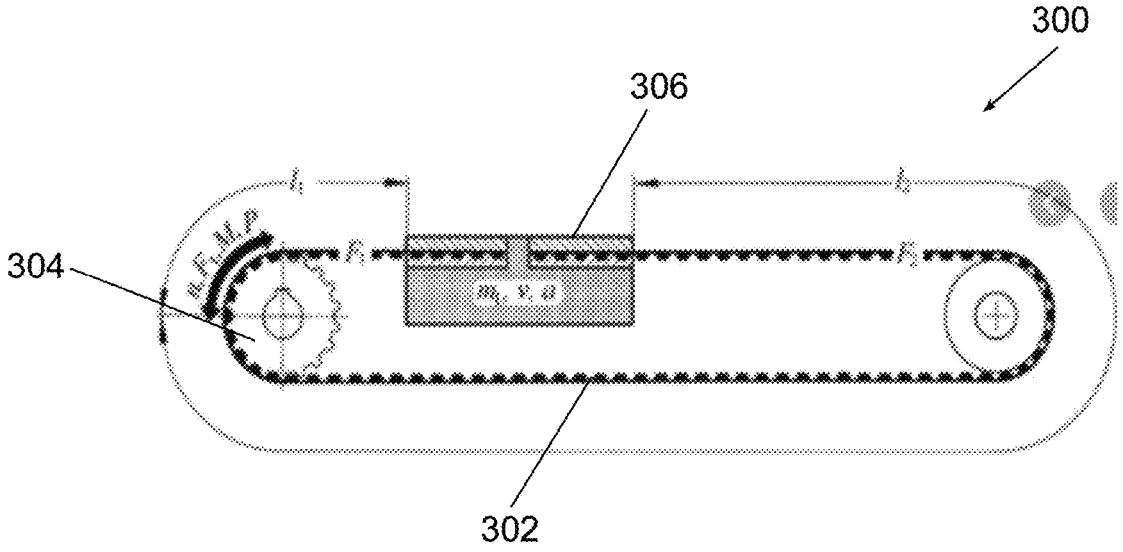
FIG. 13 is a side, schematic view of the drive system of FIG. 12.

FIGS. 12 and 13 show an exemplary drive system 300 including a toothed belt 302 that is driven by a drive gear 304. A carriage 306 is connected to the belt 302. The carriage 306 can be connected to one of the doors 212, 244 (e.g., by an actuator assembly) to move the door between the open and closed position. The position of the carriage 306 can be fixed to the belt 302, and movement of the belt 302 by the drive gear 304 can adjust the position of the carriage 306 to open and close the door. The drive gear 304 can be driven by a DC variable speed motor or a DC stepper motor. It will be appreciated that each door 212, 244 has its own drive system 300 to move the corresponding door 212, 244 between opened and closed positions.

Figure 14:
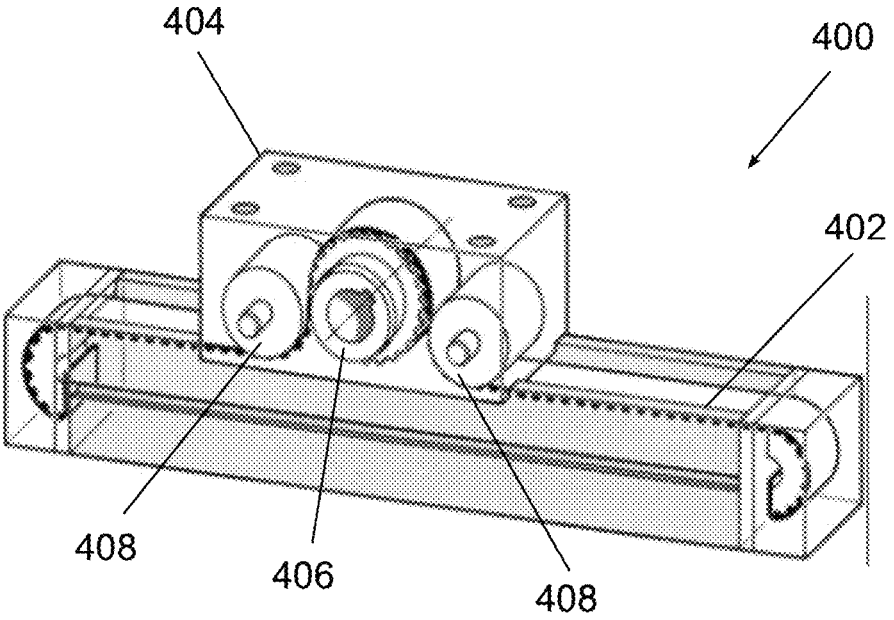
FIG. 14 is a perspective, schematic of an exemplary drive system that can be used with the track door system.
Figure 15:
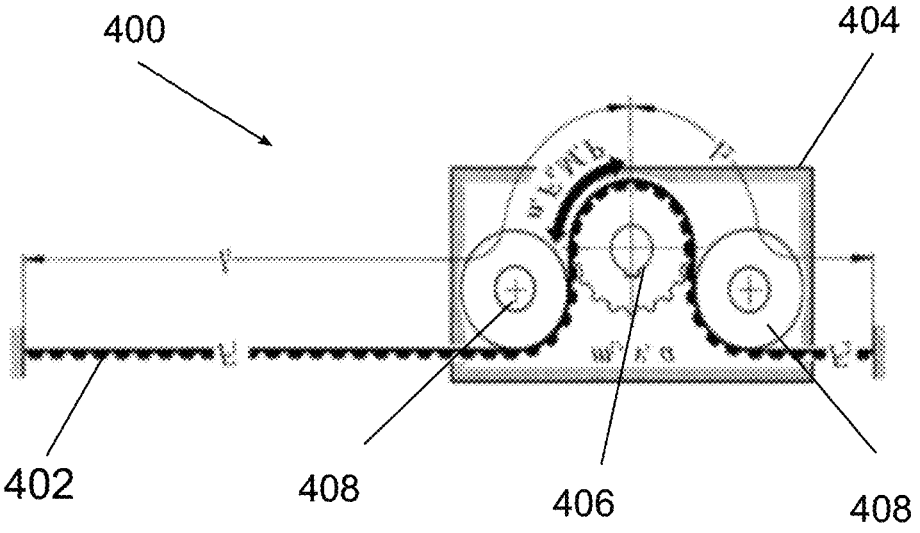
FIG. 15 is a side, schematic view of the drive system of FIG. 14.

FIGS. 14 and 15 show another exemplary drive system 400 that includes a toothed belt 402. A carriage 404 is connected to the belt 402. The carriage includes a drive gear 406 and a pair of tension wheels 408. The carriage 404 can be connected to one of the doors 212, 244 (e.g., by an actuator assembly) to move the door between the open and closed position. The position of the carriage 404 is variable to the belt 402, and movement of the drive gear 406 adjust the position of the carriage 404 relative to the belt 402 to open and close a door. The drive gear 406 can be driven by a DC variable speed motor or a DC stepper motor. The tension wheels 408 keep the belt 404 engaged with the drive gear 406. One of the tensions wheels 408 can be connected to a bias mechanism (e.g., a spring or other mechanism that biases the wheel 408) that adjusts the position of the tension wheel 408 relative to the drive gear 406 to hold tension on the belt 404 and to allow for movement of the slider 404 as the door moves toward and away from the case frame. In some embodiments, the tension wheel 408 can be biased along an axis tangential to the drive gear 406, although other directions of tension can be applied. It will be appreciated that each door 212, 244 has its own drive system 400 to move the corresponding door 212, 244 between opened and closed positions.

Figure 16:
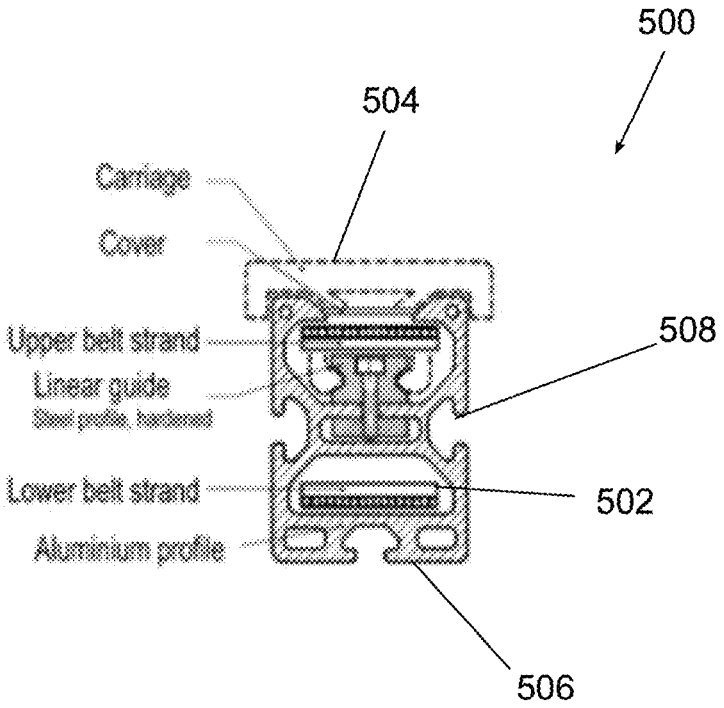
FIG. 16 is a sectional, schematic view of an exemplary drive system that can be used with the track door system.

FIG. 16 shows another exemplary drive system 500 that includes a toothed belt 502 driven by a drive gear (not shown in FIG. 16). A carriage 504 is connected to the belt 502. The carriage 504 can be connected to one of the doors 212, 244 (e.g., by an actuator assembly) to move the door between the open and closed position. The position of the carriage 504 can be fixed to the belt 502, and movement of the belt 502 by the drive gear can adjust the position of the carriage 504 to open and close a door. The drive gear can be driven by a DC variable speed motor or a DC stepper motor. The components of the drive system 500 are connected to an extruded rail 506. The rail 506 can include one or more connection features 508 that allow different components (e.g., a cover or other decorative elements) to be connected to the drive system. It will be appreciated that each door 212, 244 has its own drive system 500 to move the corresponding door 212, 244 between opened and closed positions.

In some embodiments, a drive system for each door may include combinations of the components described relative to and illustrated in FIGS. 12-16. For example, the moveable drive belt 302 with the fixed carriage 306 shown in FIGS. 12 and 13 may be used with a drive gear 304 that works in combination with one or more tensioning wheels 408 that are described relative to FIGS. 14 and 15. Other combinations of drive system components are also possible.

The invention claimed is:

1. A refrigerated merchandiser comprising:

a case defining and separating a product display area from an ambient environment, the case having a frame defining one or more openings to the product display area;

an upper track connected to the case and extending at least partially along the frame, the upper track having a center portion, a first door end extending from the center portion, a first door spur extending from the center portion, a second door end extending from the center portion, and a second door spur extending from the center portion;

a first door movably connected to the upper track, the first door having a first leading roller configured to be move between the first door spur and the center portion and a first trailing roller configured to be moved between the first door end and the center portion; and a second door movably connected to the upper track, the second door having a second leading roller configured to be move between the second door spur and the center portion and a second trailing roller configured to be moved between the second door end and the center portion;

a first gate positioned between the first door spur and the center portion and controllable to selectively prevent movement of the first door between a closed position and a first open position, a second gate separate from the first gate and positioned between the second door spur and the center portion and controllable to selectively prevent movement of the second door between a closed position and a first open position, wherein the first door is configured to move between the closed position adjacent the frame and the first open position in which the first door is positioned over the second door, and wherein the second door is configured to move between a closed position adjacent the frame and a second open position in which the second door is positioned over the first door, wherein the first gate is rotatable between a first position in which the first gate blocks a path between the first door spur and the center portion to prevent the first door from opening, and a second position in which the first gate opens into the center portion to provide a path between the first door spur and the center portion to allow the first door to open.

2. The refrigerated merchandiser of claim 1, wherein the first gate includes a first linear channel and a first curved channel, and wherein the first gate moves between the first position where the first linear channel is aligned with the center portion and the second position where the first curved channel is aligned with the center portion.

3. The refrigerated merchandiser of claim 1, wherein the first door and the second door are connected to a lower track.

4. The refrigerated merchandiser of claim 1, wherein the first door is connected to a first linear actuator and the second door is connected to a second linear actuator, and wherein the first door is independently relative to the second door.

5. The refrigerated merchandiser of claim 4, wherein the first door includes a first actuator roller and the first actuator roller is connected to a first actuator rail.

6. The refrigerated merchandiser of claim 5, wherein the first linear actuator includes a first lead screw keyed to the first actuator rail.

7. The refrigerated merchandiser of claim 1, wherein the first door and the second door are connected to a belt drive.

8. The refrigerated merchandiser of claim 7, wherein the belt drive includes a drive gear and a tensioning wheel, wherein the tensioning wheel is connected to a biasing member that biases the tensioning wheel toward the drive gear.

* * * * *